US010351928B2

(12) United States Patent
Affaticati et al.

(10) Patent No.: US 10,351,928 B2
(45) **Date of Patent: *Jul. 16, 2019**

(54) RESISTANCE ANNEALING FURNACE TO ANNEAL A METAL WIRE, STRAND, STRING, WIRE ROD OR STRAP

(71) Applicant: SAMP S.P.A. CON UNICO SOCIO, Bentivoglio (IT)

(72) Inventors: Artemio Affaticati, Busto Arsizio (IT); Roberto Conte, Bentivoglio (IT)

(73) Assignee: SAMP S.P.A. CON UNICO SOCIO (IT)

( * ) Notice: Subject to any disclaimer, the term of this patent is extended or adjusted under 35 U.S.C. 154(b) by 188 days.

This patent is subject to a terminal disclaimer.

(21) Appl. No.: 15/034,025

(22) PCT Filed: Nov. 4, 2014

(86) PCT No.: PCT/IB2014/065796

§ 371 (c)(1),
(2) Date: May 3, 2016

(87) PCT Pub. No.: WO2015/063748

PCT Pub. Date: May 7, 2015

(65) Prior Publication Data

US 2016/0281191 A1 Sep. 29, 2016

(30) Foreign Application Priority Data

Nov. 4, 2013 (IT) ..... BO2013A0601

(51) Int. Cl.
*C21D 9/62* (2006.01)
*F27D 19/00* (2006.01)
(Continued)

(52) U.S. Cl.
CPC ..... *C21D 9/62* (2013.01); *C21D 9/56* (2013.01); *F27D 11/04* (2013.01); *F27D 19/00* (2013.01); *H05B 1/023* (2013.01)

(58) Field of Classification Search
CPC .. C21D 9/56; C21D 9/62; F27D 11/04; F27D 19/00; H05B 1/023
(Continued)

(56) References Cited

U.S. PATENT DOCUMENTS 3,792,684 A * 2/1974 Janatka ..... H05B 3/0009 118/620
3,842,239 A * 10/1974 Ellinghausen ..... C21D 9/62 219/155
(Continued)

FOREIGN PATENT DOCUMENTS

CN 102227867 A 10/2011
DE 3326162 A1 2/1985
(Continued)

OTHER PUBLICATIONS

International Search Report, PCT/IB21014/065796, dated May 27, 2015 Third Party Observations, dated Mar. 7, 2016 (1 page) Third Party Observations, dated Mar. 7, 2016 (7 page).
(Continued)

*Primary Examiner* — Jessee R Roe
*Assistant Examiner* — Michael Aboagye
(74) *Attorney, Agent, or Firm* — Matthew A. Pequignot; Pequignot + Myers

(57) ABSTRACT

A resistance annealing furnace for annealing a metal wire, strand, string, wire rod or strap having at least two electric axes, which are provided with respective pulleys for conveying the metal wire, and DC voltage generator means suppliable by an AC voltage source to generate an annealing voltage applied between the two electric axes. The DC voltage generator means has a first voltage rectifier stage connectable to the AC voltage source to generate an intermediate DC voltage, an active power filter, connected so as to compensate the current harmonics at the input of the first voltage rectifier stage, a pulse width modulator to transform the intermediate voltage into a first PWM voltage, a voltage transformer to transform the first PWM voltage into a corresponding second PWM voltage, and second voltage
(Continued)

rectifier means to transform the second modulated PWM voltage into the annealing voltage.

11 Claims, 2 Drawing Sheets

(51) Int. Cl.
*F27D 11/04* (2006.01)
*C21D 9/56* (2006.01)
*H05B 1/02* (2006.01)

(58) Field of Classification Search
USPC ..... 266/104, 252, 249; 219/50, 492, 67, 219/121.34, 121.39, 121.54, 121.57, 635, 219/601
See application file for complete search history.

(56) References Cited

U.S. PATENT DOCUMENTS

| | | | | |
|---|---|---|---|---|
| 4,154,432 | A * | 5/1979 | Janatka | C21D 9/62 118/420 |
| 5,700,335 | A | 12/1997 | Phillip | 148/508 |
| 6,177,645 | B1 * | 1/2001 | Church | B23K 9/1006 219/121.39 |
| 8,309,878 | B2 * | 11/2012 | Winn | B23K 9/1075 219/121.11 |
| 8,420,986 | B2 * | 4/2013 | Hendricks | H05B 1/0252 219/494 |
| 2016/0273068 | A1 * | 9/2016 | Affaticati | C21D 9/56 |

FOREIGN PATENT DOCUMENTS

| | | | |
|---|---|---|---|
| DE | 3326162 | C2 | 2/1985 |
| DE | 19527827 | A1 | 1/1997 |
| EP | 0 779 370 | A1 | 6/1997 |
| EP | D-109771 | | 6/2016 |
| JP | 2001-335846 | | 12/2001 |
| JP | 10-298669 | | 10/2010 |
| WO | WO 2013/136772 | A1 | 9/2013 |

OTHER PUBLICATIONS

Chinese Patent Abstract No. CN102227867A, Published Oct. 26, 2011.
Office Action issued in Chinese Patent Appl. No. 201480066077.7 dated Jun. 1, 2017.
Office Action, EPO Application No. 14 812 614.7 (submitted herewith).

* cited by examiner

RESISTANCE ANNEALING FURNACE TO ANNEAL A METAL WIRE, STRAND, STRING, WIRE ROD OR STRAP

RELATED APPLICATION DATA

This application is the national stage entry of International Appl. No. PCT/IB2014/065796, filed Nov. 4, 2014, which claims priority to Italian Patent Application No. BO2013A000601, filed Nov. 4, 2013. All claims of priority to such applications are hereby made, and such applications are hereby incorporated in their entirety by reference.

TECHNICAL FIELD

The present invention relates to a resistance annealing furnace for annealing a metal wire, strand, string, wire rod or strap.

In particular, the present invention is advantageously, but not exclusively applied to an in-line resistance annealing furnace, i.e. placed directly at the outlet of a machine for manufacturing a metal wire or wire rod, e.g. a drawing machine, to which explicit reference will be made in the following description without because of this losing in generality.

BACKGROUND ART

A direct current resistance annealing furnace adapted to be arranged in-line with a drawing machine normally comprises at least two, and in particular three, electric axes, provided with respective pulleys and motorized to feed the metal wire, a plurality of idle or motorized transmission rolls and a motorized outlet pull ring. The transmission rolls and the outlet pull ring are arranged so as to define a given path for the wire, which starts about a first electric axis, turns about the other two electric axes and the transmission rolls and ends about the outlet pull ring.

The annealing furnace comprises an electric apparatus for generating a direct current voltage which is applied between the second electric axis and the other two electric axes, i.e. the positive potential of the electric voltage is applied to the second electric axis and the negative potential of the electric voltage is applied to both the first and the third electric axis. The annealing process occurs by Joule effect due to the current passage in the first wire lengths between the second electric axis and the other two (first and third) electric axes.

The path of the wire is divided into a first pre-heating stretch, which goes from the first electric axis to the second electric axis, a real annealing stretch, which goes from the second electric axis to the third electric axis, and a cooling stretch, which goes from the third electric axis to the outlet pull ring. The pre-heating stretch is longer than the annealing stretch so that the temperature of the wire in the pre-heating stretch is lower than in the annular stretch.

The electric voltage applied between the annealing axes and the corresponding electric current which circulates in the wire are commonly known as "annealing voltage" and "annealing current", and in general depend on the length of the pre-heating and annealing stretches, on the feeding speed of the wire along the path and on the section of the wire. In particular, it is known to represent the dependence between annealing voltage and feeding speed of the wire by using a so-called annealing curve. According to the annealing curve, the required annealing voltage increases as the feeding speed increases. Furthermore, the annealing current, in general, increases as the cross section of the wire increases. Over given wire section values, the maximum wire speed value is determined by various factors, such as, for example, the cooling capacity of the cooling stretch. It derives that the speed may be high for small cross sections of the wire, to which low annealing currents correspond, and thus the annealing voltage must be high. On the other hand, the speed must be lower for large cross sections, to which high annealing current correspond, and thus the annealing voltage must be lower.

The electric apparatus comprises a three-phase transformer, in which the primary circuit is supplied by the three-phase network, e.g. the 400 V and 50 Hz three-phase network, and a controlled rectifier circuit, which is coupled to the secondary circuit of the transformer to supply the annealing voltage. In order to reach the required annealing temperatures (a few hundreds of degrees Celsius), the transformer is sized to supply an alternating current voltage to the secondary circuit having an amplitude in the order of size of the maximum annealing voltage to be obtained and a maximum annealing current which depends on the overall features of the annealing furnace (wire path length and wire feeding speed) and on the cross section of the wire. For example, the transformer is sized to supply an alternating current voltage of approximately 70 V for a power of approximately 1000 kVA.

The rectifier typically consists of a thyristor bridge (SCR). The modulation of the annealing voltage is obtained by varying the firing angle of the thyristors. In other words, the voltage reduces, starting from the maximum value, with the reduction of the firing angle of the thyristors. However, the firing angle decreases the power factor of the apparatus, i.e. increases the reactive power which is exchanged by the apparatus with the electric network. A high reactive power results in a power engagement of the electric network which does not result in a creation of active work. Furthermore, the national authorities which control the distribution of electricity on the power network normally apply penalties when the reactive power exceeds a given percentage of the delivered active power.

A further disadvantage of the apparatus described above is the cumbersome size of the transformer, which is in fact oversized for its use because it never supplies the maximum current at the maximum voltage to the secondary circuit.

An electric apparatus which overcomes some of the drawbacks of the apparatuses described above is known. This other apparatus differs from the described one substantially in that it comprises a transformer with a plurality of tap points on the primary circuit. The tap point of the primary circuit which allows to maximize the firing angle of the thyristors of the rectifier and thus to minimize reactive power is selected according to the section of the wire to be annealed. However, the transformer with multiple tap point primary circuit is also oversized, and in all cases more complicated and costly than a transformer with a simple primary circuit. Furthermore, it is economically inconvenient to construct large-sized transformers (e.g. 70 V for 1000 kVA on the secondary circuit) with more than four tap points on the primary circuit.

A known architecture alternative to the use of a transformer with multiple tap point primary circuit comprises a simple primary circuit transformer and an AC/AC inverter coupled to the primary circuit of the transformer to adjust the power voltage of the primary circuit to a higher number of levels and thus correspondingly adjust the voltage supplied by the secondary circuit. This solution allows to reduce the reactive power further, but the drawbacks related to large sized transformer remain.

DISCLOSURE OF INVENTION

It is the object of the present invention to make a resistance annealing furnace to anneal a metal wire, which furnace is free from the drawbacks described above and which is at the same time easy and cost-effective to make.

In accordance with the present invention, a resistance annealing furnace for annealing a metal wire, strand, string, wire rod or strap is provided as defined in the appended claims.

BRIEF DESCRIPTION OF THE DRAWINGS

The present invention will now be described with reference to the accompanying drawings, which show a non-limitative embodiment thereof, in which.

BEST MODE FOR CARRYING OUT THE INVENTION

Figure 1:
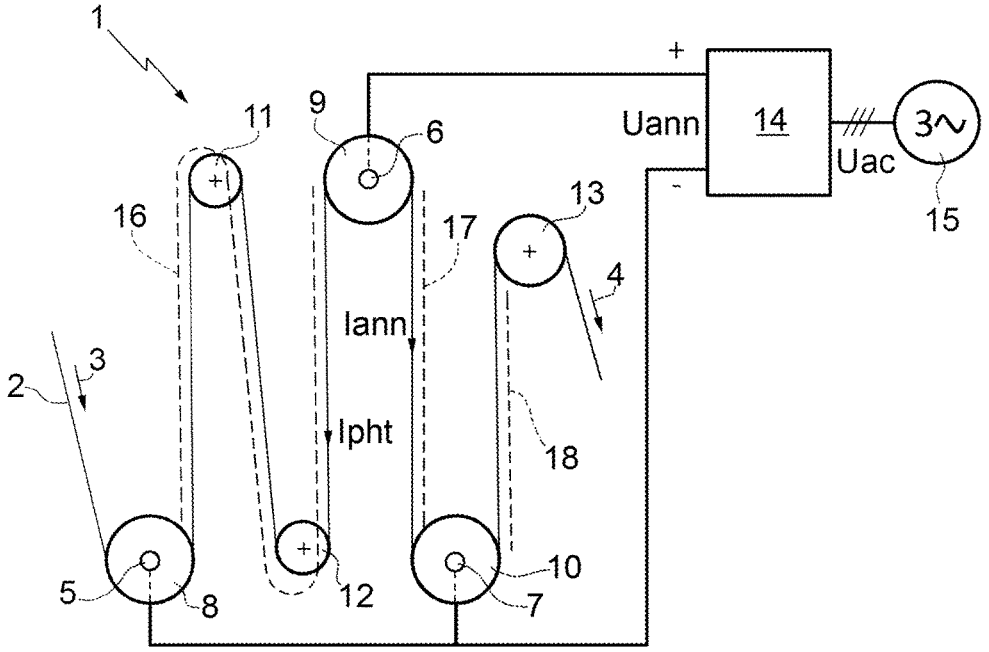
FIG. 1 schematically shows the resistance annealing furnace made according to the present invention.

In FIG. 1, reference numeral 1 generically indicates, as a whole, a direct current resistance annealing furnace for annealing a metal wire, the latter indicated by reference numeral 2, for example a copper or aluminum wire. The annealing furnace 1 is of the type adapted to be inserted in-line, i.e. at the outlet of a drawing machine (not shown). The wire 2 exits from the drawing machine and enters into the annealing furnace 1 by moving forward in direction 3 and exits from the annealing furnace 1 in direction 4.

With reference to FIG. 1, the annealing furnace 1 comprises three electric axes 5, 6 and 7, which are provided with respective pulleys 8, 9 and 10, two transmission rolls 11 and 12, which are either idle or motorized and are arranged between the first two electric axes 5 and 6, and a motorized outlet pull ring 13. The transmission rolls 11 and 12 and the outlet pull ring 13 are arranged so as to define a given path for the wire 2, which starts about pulley 8 of the electric axis 5, turns about the transmission rolls 11 and 12 and the pulleys 9 and 10 of the other two electric axes 6 and 7, and ends about the outlet pull ring 13. The wire 2 runs along such a path pulled by the outlet pull ring 13. Advantageously, electric axes 5-7 are also motorized to aid the pulling of the wire 2.

The annealing furnace 1 comprises a DC voltage generator 14, which can be supplied with an AC voltage, and in particular with the three-phase voltage Uac supplied by a three-phase electric network 15, to generate a DC voltage, the so-called "annealing voltage", indicated by Uann in the figures, which is applied between the electric axis 6 and the two electric axes 5 and 7. In other words, the positive potential of the voltage Uann is applied to the electric axis 6 and the negative potential of the voltage Uann is applied to the other two electric axes 5 and 7. The annealing process occurs by Joule effect because of the passage of electric current in the wire lengths between the electric axis 6 and the two electric axes 5 and 7.

The path of the wire 2 is divided into a pre-heating stretch, which is indicated by reference numeral 16 and goes from electric axis 6 to electric axis 5 passing through the transmission rolls 11 and 12, a real annealing stretch, which is indicated by reference numeral 17 and goes from electric axis 6 to electric axis 7, and a cooling and drying stretch, which is indicated by reference numeral 18 and goes from electric axis 7 to the outlet pull ring 13. In the case of the considered example, in which the wire 2 is made of copper or aluminum, the pre-heating stretch 16 is longer than the annealing stretch 17 so that a current Iprh, which is lower than the current Iann that circulates in the wire portion 2 along the stretch 17, circulates in the portion of wire 2 along the stretch 16, the section of the wire 2 being equal. In such a manner, the temperature of the wire 2 in stretch 16 will be lower than that of the wire 2 in stretch 17. The cooling and drying stretch 18 crosses a tank full of cooling liquid and is provided with drying devices, the tank and the drying devices being known per se and thus not shown.

Figure 2:
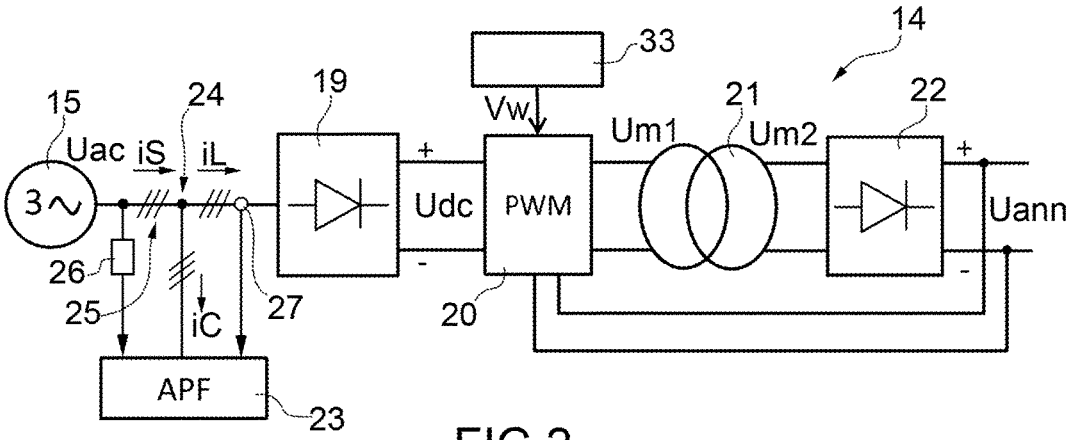
FIG. 2 shows the annealing voltage generator of the furnace in FIG. 1 by means of a block chart.

With reference to FIG. 2, according to present invention, the voltage generator 14 comprises an input voltage rectifier stage 19, which has its input connected to the three-phase electric network 15 by means of a three-phase line or bus 25 to be supplied by three-phase voltage Uac and is adapted to supply an intermediate DC voltage, indicated by Udc, an intermediate pulse width modulating stage 20, or more simply a PWM modulator stage, to transform the intermediate voltage Udc into a first PWM voltage, which is indicated by Um1, has a zero mean value and an amplitude substantially equal to the intermediate voltage Udc, a high-frequency voltage transformer 21 with transformation ratio higher than 1 to transform the voltage Um1 into a corresponding second PWM voltage, which is indicated by Um2 but has a mean value other than zero and an amplitude smaller than that of the voltage Um1, an output voltage rectifier stage 22 for transforming the voltage Um2 into the annealing voltage Uann, and a three phase active power filter (APF) 23, hereinafter named active filter for the sake of simplicity, connected in parallel to the internal three-phase electric line 25 in point 24 of the same.

Figure 3:
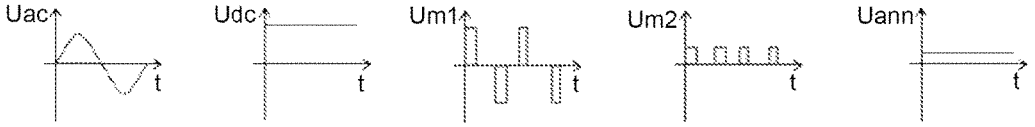
FIG. 3 shows the voltage wave forms in various intermediate points of the voltage generator of the FIG. 2.

FIG. 3 shows, in a qualitative manner and by way of example only, the wave forms of the various voltages Uac, Udc, Um1, Um2 and Uann.

The rectifier stage 19 is of the passive non-controlled type, and in particular comprises a three-phase rectifier diode bridge and a low-pass filter LC. By way of example, assuming that the three-phase voltage Uac is 400 V and 50 Hz, the rectifier stage 19 supplies an intermediate voltage Udc, which is approximately comprised between 530 and 540 V, impressing a three-phase current iL having a reactive component which determines a power factor lower than 0.8 on the three-phase line 25.

The active filter 23, which is known per se, and thus not shown in detail, has the function of reducing the current harmonics which distort the three-phase current iL input to the rectifier stage 19. Such current harmonics are produced by the PWM modulating stage 20, which is the load of the rectifier stage 19. In other words, the function of the active filter 23 is to increase the power factor seen from the three-phase electric network 15. The active filter 23 comprises a controlled three-phase bridge comprising a plurality of IGBT devices, an LC filter connected upstream of the three-phase bridge, a plurality of capacitors connected as load of the three-phase bridge and a control unit to control the three-phase bridge.

A triad of voltage sensors 26 connected to the three-phase line 25 upstream of the connection point 24 of the active filter 23 are combined with the active filter 23 to measure the three-phase voltage Uac, and a triad of current sensors 27 are coupled to the three-phase line 25 downstream of the connection point 24 of the active filter 23 to measure the three-phase current iL. The control unit of the active filter 23 controls the three-phase bridge as a function of the signals supplied by the sensors 26 and 27, i.e. as a function of the voltage and current measured by means of the sensors 26 and 27 so that the active filter 23 draws from the three-phase line 25 a three-phase current iC which added to the three-phase current iL impresses a three-phase current iS which is not distorted, and thus substantially sinusoidal, on the three-phase electric network 15. In other words, the active filter 23 introduces in the three-phase line 25 current harmonics which substantially compensate those at the input of the rectifier stage 19. The active filter 23 allows to obtain a power factor, seen from the three-phase electric network 15, which is greater than 0.95.

Figure 4:
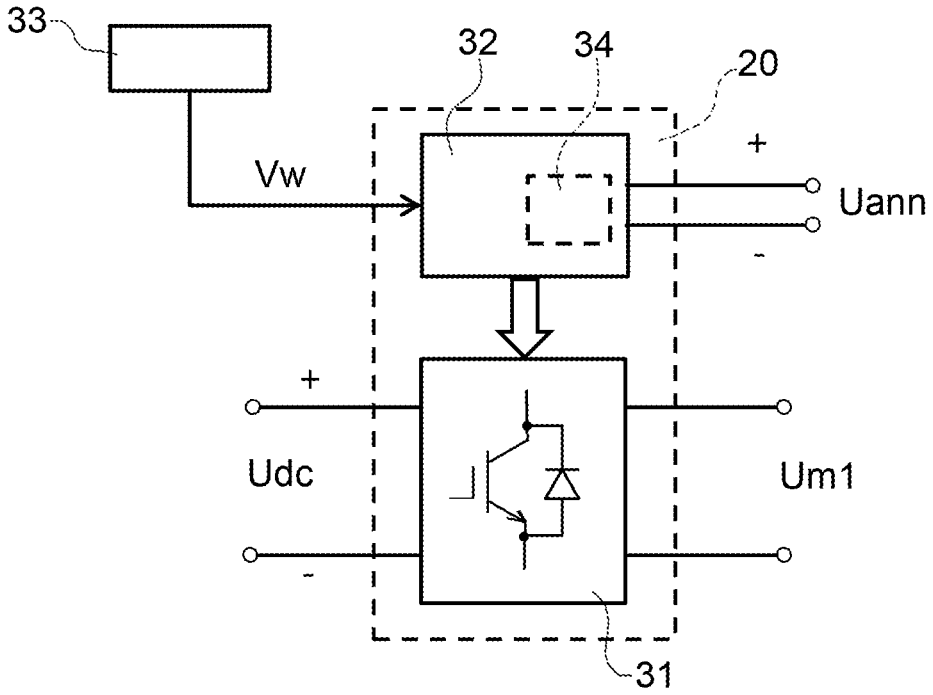
FIG. 4 shows an inner stage of the voltage generator of the FIG. 2, in greater detail.

With reference to FIG. 4, the PWM modulating stage 20 comprises a bridge H of electronic switching devices 31, and in particular IGBT devices, supplied by the intermediate voltage Udc, and a controller 32, which is configured to control the bridge H 31 so as to generate the voltage Um1 and modulate the width of the pulse of the voltage Um1 in a manner correlated with the ratio between the current feeding speed of the wire 2, indicated by Vw in FIGS. 2 and 5, and the difference between the maximum value and the minimum value of the feeding speed. The maximum and minimum values of the feeding speed of the wire 2 depend on the features of the annealing furnace 1. The voltage frequency Um1 is predetermined according to the performance of the IGBT devices and of the voltage transformer 21.

At each value of speed Vw corresponds a desired annealing voltage, hereinafter named "annealing setpoint" Uref. The annealing voltage can be calculated by multiplying the square root of the feeding speed of the wire 2 by a constant K, which depends on the overall features of the annealing furnace 1 and which can be determined according to known techniques. The controller 32 receives the speed Vw of the wire 2 from the external device 33, for example the control unit of the drawing machine connected to the inlet of the annealing furnace 1 or a speed acquisition unit coupled to one of the members rotating at the speed of the wire 2 (a transmission roll 11, 12, an electric axis 5, 6, 7 or the pull ring 13). The controller 32 is configured to calculate the annealing setpoint Uref by multiplying the square root of the speed Vw by the constant K. So, the annealing setpoint Uref varies between a minimum value Uref min and a maximum value Uref max.

More in detail, the controller 32 controls the bridge H 31 by adjusting the conduction offset, i.e. the conduction delay of one side (half) of the bridge H 31 with respect to the other, proportionally to the ratio between the annealing setpoint Uref and the difference between Uref min and Uref max. Thus, the modulated signal Um1 has a duty cycle which varies between 0 and 0.5 as a function of the conduction delay set by the controller 32. In particular, the minimum value Uref min corresponds to the duty cycle equal to a 0 and the maximum value Uref max corresponds to the duty cycle equal to a 0.5 (square wave with zero mean value).

The controller 32 comprises voltage measuring means comprising an A/D converter 34 connected to the outlet of the passive rectifier stage 22 to measure the annealing voltage value Uann according to known techniques. The controller 32 controls the bridge H 31 by adjusting the conduction offset also as a function of the measured values of the annealing voltage Uann so that the annealing voltage Uann follows the annealing setpoint Uref. Indeed, during annealing, the current which circulates in the wire 2 varies as a function of the work-hardening state of the material of the wire 2 and of the quality of the contact between the wire 2 and the pulleys 8-10.

The voltage transformer 21 is a single-phase, high-frequency power transformer, i.e. capable of operating at frequencies higher than 5 kHz. This allows to program the PWM modulating stage 20 so that it generates the voltage Um1 at a frequency higher than 5 kHz, and preferably equal to a 8 kHz.

Furthermore, the voltage transformer 21 has a secondary circuit winding with central zero so as to transform the voltage Um1 with zero mean value into the voltage Um2 with non-zero mean voltage, and has a nominal transformation ratio which is predetermined as a function of the intermediate voltage Udc and of the maximum value Uref max. Assuming a maximum value Uref max equal to a 100 V, which allows to anneal a wide range of section values of the wire 2 and a wide range of feeding speeds of the wire 2, and assuming that an intermediate voltage is equal to 600 V, the nominal transformation ratio is equal to 6.

The voltage transformer 21 described above is much smaller and thus more costly of the voltage transformers of the known electric apparatuses for generating the annealing voltage, the materials used being equal.

The rectifier stage 22 is of the non-controlled, passive type, and in particular comprises two diodes, each of which is associated to a respective half of the secondary circuit of the voltage transformer 21 to operate as a half-wave rectifier, and a low-pass filter LC connected downstream of the diodes.

It is worth noting that the voltage generator 14 is not limited to the use in in-line resistance annealing furnaces for wires, but is also adapted for use in resistance annealing furnaces for metal strands, strings, wire rods or straps, fed either in-line or off-line, i.e. fed wound as a simple skein or about a coil or a metal or cardboard drum.

Furthermore, the voltage generator 14 can be generically used also in annealing furnaces 1 having only two electric axes, i.e. without the pre-heating stretch of the wire, strand, string, wire rod or metal strap.

The main advantage of the annealing furnace 1 described above is to minimize the reactive power exchanged with the three-phase electric network 15 by virtue of the presence of the active filter 23 placed on the three-phase line 25 at the inlet of the voltage generator 14. Furthermore, the annealing furnace 1 may be easily configured for annealing metal wires, strands, strings, wire rods or straps having a cross section variable in a wide range of values and in a wide range of feeding speeds of the metal wire, strand, string, wire rod, or strap by virtue of the presence of the PWM modulator 20 connected between the active supplying stage 19 and the voltage transformer 21. Finally, the high-frequency single-phase voltage transformer 21 is considerably more compact and cost-effective than a 50 Hz three-phase transformer, typically used in known annealing furnaces.

The invention claimed is:

1. A resistance annealing furnace for annealing a metal wire, strand, string, wire rod or strap, the annealing furnace (1) comprising at least two electric axes (5-7), which are provided with respective pulleys (8-10) to convey said metal wire (2), strand, string, wire rod or strap, and a DC voltage generator (14) suppliable by an AC voltage source (15) in order to generate an annealing voltage (Uann) applied between the at least two electric axes (5-7), so as to produce an electric current in a section of the metal wire (2), strand, string, wire rod or strap comprised between the at least two electric axes (5-7) that provokes the annealing due to Joule effect; said DC voltage generator (14) comprising a first voltage rectifier (19) connectable to said AC voltage source (15) so as to generate an intermediate DC voltage (Udc), an active filter (23), which is connected in parallel to an input of said first voltage rectifier (19) so as to compensate for current harmonics appearing at the input of said first voltage rectifier means (19), a pulse width modulator (PWM) (20) to transform the intermediate voltage (Udc) into a first PWM voltage (Um1) with the same amplitude, a voltage transformer (21) to transform the first PWM voltage (Um1) into a corresponding second PWM voltage (Um2) with a smaller amplitude, and a second voltage rectifier (22) to transform the second modulated PWM voltage (Um2) into the annealing voltage (Uann).

2. An annealing furnace according to claim 1, wherein said first voltage rectifier (19) is passive and non-controlled.

3. An annealing furnace according to claim 1, wherein said active filter (23) comprises a bridge of insulated-gate bipolar transistor devices, an LC filter, which is connected upstream of said bridge of insulated-gate bipolar transistor devices, a plurality of capacitors, which are connected as a load of the bridge of insulated-gate bipolar transistor devices, and a first controller to control the bridge of insulated-gate bipolar transistor devices so as to perform the compensation of said current harmonics.

4. An annealing furnace according to claim 3, wherein said DC voltage generator (14) comprise an AC bus (25) to connect input of said first voltage rectifier (19) to said AC voltage source (15), said active filter (23) being connected in a point (24) of said AC bus (25); said DC voltage generator (14) comprising a voltage sensor (26) to measure the AC voltage (Uac) upstream of said point (24) of the AC bus (25) and a current sensor (27) to measure the current downstream of said point (24) of the AC bus (25); said first controller controlling said bridge of insulated-gate bipolar transistor devices as a function of the voltage and current values obtained by means of said voltage and current sensors (26, 27).

5. An annealing furnace according to claim 1, wherein said pulse width modulator (20) is configured to modulate the pulse width of said first PWM voltage (Um1) in correlation with the ratio between a feeding speed (Vw) of said metal wire (2), strand, string, wire rod or strap and a difference between a maximum value and a minimum value of said feeding speed.

6. An annealing furnace according to claim 1, wherein said pulse width modulator (20) comprises an H bridge of electronic switching devices (31) supplied with said intermediate voltage (Udc), and a second controller (32) configured to control said H bridge of electronic switching devices (31) so as to generate said first PWM voltage (Um1) and modulate it in correlation with the ratio between a feeding speed (Vw) of said metal wire (2), strand, string, wire rod or strap and a difference between a maximum value and a minimum value of said feeding speed.

7. An annealing furnace according to claim 1, wherein said pulse width modulator (PWM) (20) comprises an H bridge of electronic switching devices (31) supplied with said intermediate voltage (Udc), voltage measuring unit (34) that measures said annealing voltage (Uann), and a second controller (32) configured to calculate an annealing voltage desired value (Uref) as a function of a feeding speed (Vw) of said metal wire (2), strand, string, wire rod or strap and to control the H bridge of electronic switching devices (31) so as to generate said first PWM voltage (Um1) and modulate it as a function of said annealing voltage desired value (Uref) and of the measured values of the annealing voltage (Uann), so that the latter follows the annealing voltage desired value (Uref).

8. An annealing furnace according to claim 6, wherein said H bridge of electronic switching devices comprises an H bridge of insulated-gate bipolar transistor devices (31).

9. An annealing furnace according to claim 1, wherein said voltage transformer (21) is a high-frequency power transformer and said first and second PWM voltages (Um1, Um2) have the same frequency, which is higher than 5 kHz.

10. An annealing furnace according to claim 2, wherein said first voltage rectifier comprises a rectifier diode bridge and an LC low-pass filter.

11. An annealing furnace according to claim 9, wherein said first and second PWM voltages (Um1, Um2) have the same frequency equal to 8 kHz.

* * * * *